United States Patent [19]

Shimoie

[11] 4,398,861

[45] Aug. 16, 1983

[54] MANEUVERING PORTION STRUCTURE OF AN EXCAVATION WORK VEHICLE

[75] Inventor: Shizuo Shimoie, Sakai, Japan

[73] Assignee: Kubota Ltd., Japan

[21] Appl. No.: 220,030

[22] PCT Filed: Aug. 22, 1980

[86] PCT No.: PCT/JP80/00192

§ 371 Date: Dec. 2, 1980

§ 102(e) Date: Dec. 2, 1980

[87] PCT Pub. No.: WO82/00676

PCT Pub. Date: Mar. 4, 1982

[51] Int. Cl.[3] ..... E02F 9/20

[52] U.S. Cl. ..... 414/694; 414/685; 74/471 XY; 137/637.1

[58] Field of Search ..... 414/685, 694; 74/471 XY; 137/269, 271, 637.1; 37/DIG. 1, DIG. 7, 103

[56] References Cited

U.S. PATENT DOCUMENTS 3,831,633 8/1974 Comer ..... 74/471 XY X 4,028,958 6/1977 Schuermann et al. ..... 74/471 XY 4,098,286 7/1978 Prime ..... 74/471 XY X 4,140,144 2/1979 Dowd et al. ..... 137/271 X

*Primary Examiner*—Robert J. Spar

*Assistant Examiner*—Terrance L. Siemens

*Attorney, Agent, or Firm*—Kane, Dalsimer, Kane, Sullivan and Kurucz

[57] ABSTRACT

Control handle structure of an excavation work vehicle comprising; two maneuvering levers (14),(15) operable crosswise in back-and-forth and right-and-left directions of the vehicle body, maneuvering valves ($V_1$), ($V_2$),($V_5$),($V_8$) for boom swiveling, arm rocking, bucket pivoting and boom up-and-down rocking, and an interlocking mode change-over mechanism (30) disposed between said two maneuvering levers (14),(15) and said maneuvering valves ($V_1$),($V_2$),($V_5$),($V_8$) for changing the mode of the interlocking therebetween, whereby any maneuvering mode properly suited to an operator may be readily realized, thus resulting in enhancing work efficiency and decreasing possibility of erroneous maneuvering.

8 Claims, 13 Drawing Figures

MANEUVERING PORTION STRUCTURE OF AN EXCAVATION WORK VEHICLE

BACKGROUND OF THE INVENTION

This invention relates to a control handle structure of an excavation work vehicle, which connects a maneuvering valve for boom swiveling, a maneuvering valve for boom up-and-down rocking, a maneuvering valve for arm rocking and a maneuvering valve for bucket pivoting, interlockingly to two maneuvering levers adapted for free bi-directional rocking maneuvering, in a manner capable of separate individual maneuvering and capable of simultaneous maneuvering in respective pairs.

In order to maneuver, as easily and as efficiently as possible, a maneuvering valve for boom swiveling, a maneuvering valve for boom up-and-down rocking, a maneuvering valve for arm rocking and a maneuvering valve for bucket pivoting, of an excavation work vehicle, a control handle structure is used that uses two maneuvering levers adapted for free crosswise rocking maneuvering, which are capable of maneuvering separately the individual valves and capable of maneuvering simultaneously them in respective pairs.

As for the interlocking connection of the two maneuvering levers and the four maneuvering valves in conventional instances, a mode has been adopted, wherein one interlockingly connects respective pairs of the maneuvering valves each closely interrelated as to the maneuvering, thus in two sets, and one respectively connects them simply to the said two maneuvering levers, via four interlocking systems comprising push-pull rods.

However, as to the interlocking relationship between said two maneuvering levers and four maneuvering valves, namely as to which particular maneuvering valve and which particular maneuvering valve to interlockingly connect to which particular maneuvering lever, it is different according to the custom prevailing in the respective countries of the world and to the particular manufacturers.

As is again referred to in detail in the later-described embodiment of this invention, it is generally the case that for instance in England they connect the maneuvering valve for boom up-and-down rocking and the maneuvering valve for bucket pivoting, interlockingly to one maneuvering lever adapted for free bi-directional rocking, and connect the maneuvering valve for arm rocking and the maneuvering valve for boom swiveling, interlockingly to the other maneuvering lever adapted for free bi-directional rocking, while in the U.S.A. they connect the maneuvering valve for arm rocking and the maneuvering valve for bucket pivoting, interlockingly to one maneuvering lever, and connect the maneuvering valve for boom up-and-down rocking and the maneuvering valve for boom swiveling, interlockingly to the other maneuvering lever.

Besides, there are some manufacturers also in Japan who adopt such interlocking connection structure as to maneuver the maneuvering valve for boom swiveling by the maneuvering of one maneuvering lever in the machine body back-and-forth direction.

In order to satisfy such requirements of the respective countries, including Japan as well, various forms of the maneuvering structures must have separately been manufactured, and it has thus been quite uneconomical.

Furthermore work efficiency is reduced when an operator having experience with the system of a particular manufacturer is used to operate another system, due to the operator's fear of performing erroneous maneuvers.

SUMMARY OF INVENTION

In view of the above-mentioned prior art and of the recent requirements in the various contries, this invention has as its object to provide a control handle structure of an excavation work vehicle, capable of changing over the interlocking relationship between the two maneuvering levers and four maneuvering valves.

To attain this object, the control handle structure of an excavation work vehicle, according to this invention, is characterized in that a maneuvering valve for boom swiveling, a maneuvering valve for boom up-and-down rocking, a maneuvering valve for arm rocking and a maneuvering valve for bucket pivoting are disposed substantially in parallel; that these four maneuvering valves are interlockingly connected, in a manner capable of separate individual maneuvering and capable of simultaneous maneuvering in respective pairs, via four interlocking systems parallel with one another using the respective push-pull rods, to two maneuvering levers adapted for free rocking maneuvering crosswise in back-and-forth and right-and-left directions of the machine body; and that there is provided, intermediary to the said interlocking systems, an interlocking mode change-over mechanism for changing the mode of the interlocking between the two maneuvering levers and the said four maneuvering valves.

It is therefore possible to interlockingly connect the two maneuvering levers adapted for free rocking crosswise in back-and-forth and right-and-left directions of the machine body and the maneuvering valve for boom swiveling, maneuvering valve for boom up-and-down rocking, maneuvering valve for arm rocking and maeuvering valve for bucket pivoting, in any combination therebetween as to conform to the custom or the actual state as is prevailing in the respective countries in which they use the excavation work vehicle. This results in bringing forth the advantage, by the maneuvering portion structure of this invention, of inexpensively providing the excavation work vehicle without manufacturing various specific forms of the maneuvering portion structure.

It is also possible, in the case there is any specific mode of the maneuvering lever system with which the operator is well acquainted and experienced, to change over into such mode of the maneuvering lever system properly suited to the operator, thus resulting as well in bringing forth the advantage of enhancing the work efficiency and of promoting the safety, by the conversant maneuvering sense.

The second object of this invention is to have, when the maneuvering valve for boom up-and-down rocking which controls oil of a first oilhydraulic pump is maneuvered, oil of a second oilhydraulic pump make confluence with the oil of the first oilhydraulic pump, thus to have the up-and-down rocking speed of the said boom get speed raising, and for this purpose there is provided a maneuvering valve for first confluence and it is interlockingly connected to the said maneuvering valve for boom up-and-down rocking in a manner capable of simultaneous maneuvering therewith.

Furthermore, the third object of this invention is to make, when the said maneuvering valve for boom up-and-down rocking is not in use, the oil of the first oilhydraulic pump confluence with the oil of the second oilhydraulic pump, thus to have the actuation speed of the arm rocking or the bucket pivoting or else both of them get speed raising, and for this purpose there is provided a maneuvering valve for second confluence, to be maneuvered in interlocking with push-pull actuation of the maneuvering valve for bucket pivoting or the maneuvering valve for arm rocking, in juxtaposition of the said respective maneuvering valves via a confluence maneuvering mechanism.

Other objects and advantages of this invention will become clear from the description of the specific embodiment to follow hereunder and the showing of the accompanying drawings.

BRIEF DESCRIPTION OF THE DRAWINGS

The drawings show, by way of example, the best mode of the embodiment of the control handle structure of an excavation work vehicle, according to this invention, wherein.

PREFERRED EMBODIMENT OF THE INVENTION

This invention is now explained in more detail hereunder with reference to the accompanying drawings.

Figure 1:
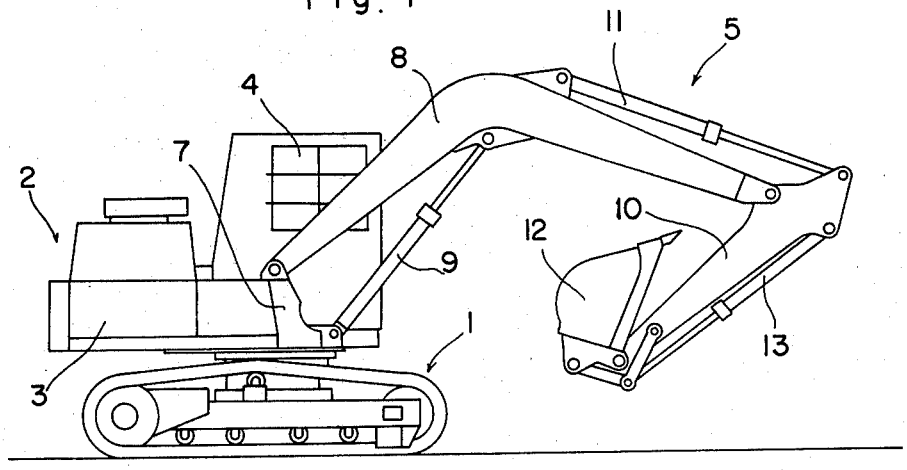
FIG. 1 is a side elevation of the excavation work vehicle.

FIG. 1 shows a shoveling work vehicle as a specific example of an excavation work vehicle of this invention. This shoveling work vehicle is provided with a swivel table (3) as attached to the machine body (2) equipped with crawler travel apparatus (1), for free pivotal maneuvering about an upright axis, and on this swivel table (3) further with an operation cab (4) and a prime mover cab as are mounted there as well as an excavation work apparatus (5). In constructing the excavation work apparatus (5), one provides a boom (8) free to rock about a perpendicular axis relative to a bracket (7) uprightly provided on the said swivel table (3), connects to a tip end of the said boom (8) an arm (10) with a bucket (12) connected at a tip end thereof, and provides: a fluid pressure cylinder (9) for rocking up and down the said boom (8) relative to the said bracket (7); a fluid pressure cylinder (11) for expansively and retractively rocking the said arm (10) about a perpendicular axis relative to the said boom (8); and a fluid pressure cylinder (13) for making the said bucket (12) pivot about a perpendicular axis relative to the said arm (10).

Figure 2:
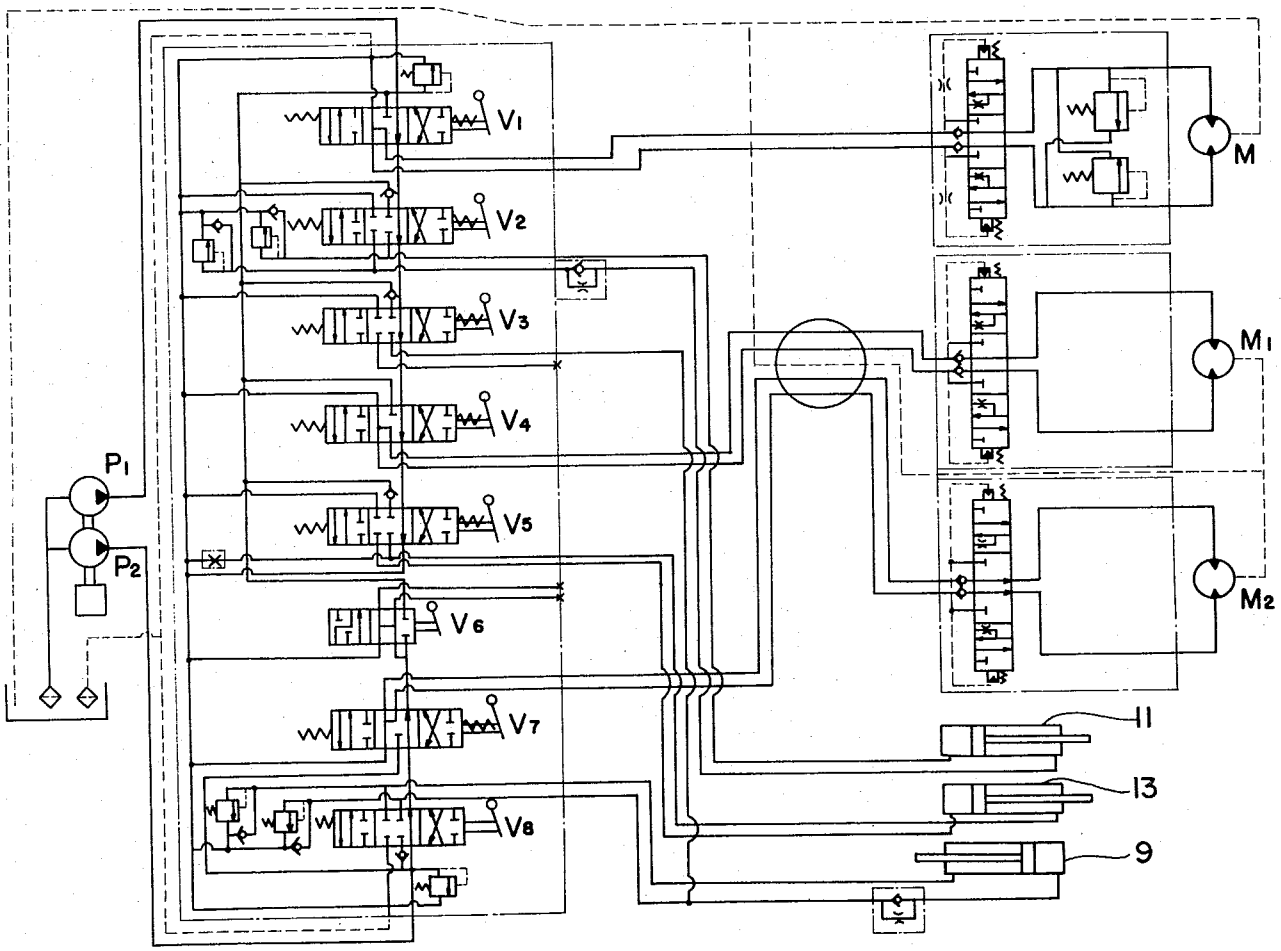
FIG. 2 is a diagram of the oilhydraulic circuit of the excavation work vehicle.

In constructing the fluid pressure driving system, as shown in FIG. 2, a maneuvering valve ($V_1$) for a fluid pressure motor (M) for swivel table driving in order to swivel the said boom (8) by the pivoting of the said swivel table (3), a maneuvering valve ($V_2$) for the cylinder (11) for arm rocking, a maneuvering valve ($V_3$) for first confluence for increasing boom raising speed, a maneuvering valve ($V_4$) for a fluid pressure motor ($M_1$) for a travel apparatus of one of the right and left crawlers, and a maneuvering valve ($V_5$) for the said cylinder (13) for bucket pivoting are constructed in a stack valve type provided with a center bypassing flow path and are parallelly connected to a first fluid pressure pump ($P_1$). A maneuvering vave ($V_8$) for the said cylinder (9) for boom up-and-down rocking, a maneuvering valve ($V_7$) for a fluid pressure motor ($M_2$) for a travel apparatus of the other of the right and left crawlers, and a maneuvering valve ($V_6$) for second confluence for causing the said arm (10) and bucket (12) to increase speed are similarly constructed in a stack valve type provided with a center bypassing flow path and are parallelly connected to a second fluid pressure pump ($P_2$).

Figure 3:
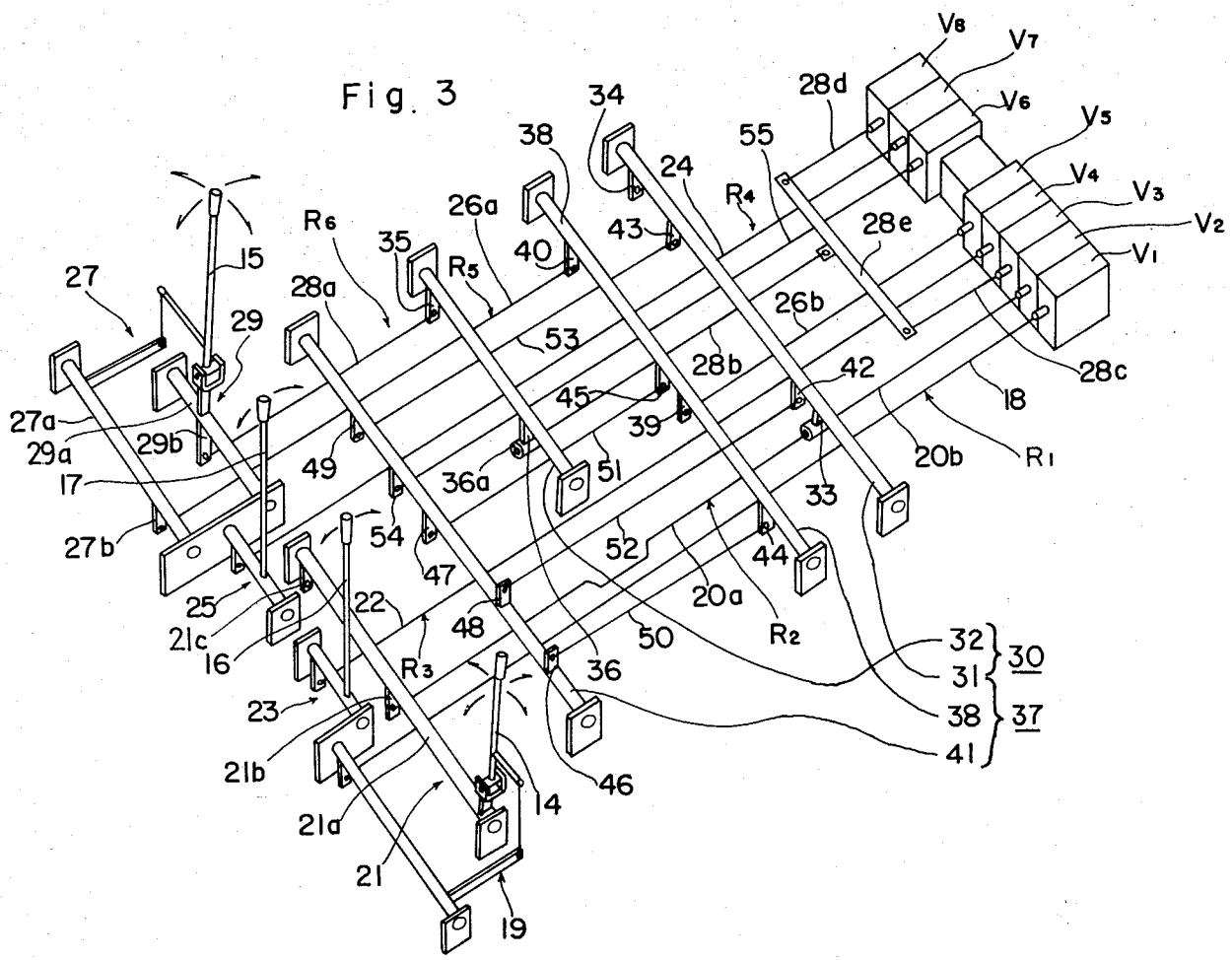
FIG. 3 is a schematic perspective view of the control handle structure.

As shown in FIG. 3, the said maneuvering valves ($V_1$)–($V_8$) are disposed in juxtaposition in the machine body transverse direction, with the respective sliding spools (not shown) in the state of extending in the machine body back-and-forth direction. Two, namely a first and a second, maneuvering levers (14),(15) adapted for free rocking maneuvering crosswise or bidirectionally in the machine body back-and-forth and right-and-left directions for maneuvering the said maneuvering valves ($V_1$),($V_2$), ($V_3$),($V_6$),($V_8$) are provided in juxtaposition in the machine body transverse direction in front of these maneuvering valves. Two, namely a third and a fourth, maneuvering levers (16),(17) adapted for free rocking maneuvering in the machine body back-and-forth direction for maneuvering the said maneuvering valves ($V_4$),($V_7$) are provided in juxtaposition in the machine body transverse direction in between the said crosswisely rocking maneuvering levers (14), (15).

The maneuvering combination mode of the said four maneuvering levers (14),(15),(16),(17) and the said eight maneuvering valves ($V_1$),($V_2$),($V_3$),($V_4$),($V_5$),($V_6$),($V_7$), ($V_8$), to be described in detail hereunder, is the mode adopted mainly in England and so forth.

The said first maneuvering lever (14) and the said maneuvering valve ($V_1$) for boom swiveling and interlockingly connected to each other by means of a first interlocking system ($R_1$) comprising a push-pull rod (18) via an interlocking member (19) so adapted that the sliding spool (without illustration) of the valve may be maneuvered in push-pull manner by the maneuvering of the said first maneuvering lever (14) in the machine transverse direction. The said first maneuvering lever (14) and the said maneuvering valve ($V_2$) for arm rocking are interlockingly connected to each other by means of a second interlocking system ($R_2$) comprising push-pull rods (20*a*),(20*b*) via an interlocking member (21) so adapted that the sliding spool (not shown) of the valve may be maneuvered in the machine body back-and-forth direction. The said third maneuvering lever (16) is interlockingly connected, by means of a third interlocking system ($R_3$) comprising a push-pull rod (22) via an interlocking member (23) adapted for maneuvering in push-pull manner the sliding spool (not shown) of the said maneuvering valve ($V_4$) of the fluid pressure motor ($M_1$) for the crawler travel apparatus on the left side, thus to the said maneuvering valve ($V_4$). The said fourth maneuvering lever (17), is interlockingly connected, by means of a fourth interlocking system ($R_4$) comprising a push-pull rod (24) via an interlocking member (25) adapted for maneuvering in push-pull manner the sliding spool (not shown) of the said maneuvering valve ($V_7$) of the fluid pressure motor ($N_2$) for the crawler travel apparatus on the right side, thus to the said maneuvering valve ($V_7$). The said second maneuvering lever (15) is interlockingly connected, by means of a fifth interlocking system ($R_5$) comprising push-pull rods (26*a*),(26*b*), via an interlocking member (27), to maneuver in push-pull manner, by the maneuvering thereof in the machine body transverse direction, the sliding spool (not shown) of the said maneuvering valve ($V_5$) for bucket pivoting, thus to the valve.

Furthermore, the said second maneuvering lever (15) is interlockingly connected, by means of a sixth interlocking system ($R_6$) comprising push-pull rods (28*a*), (28*b*),(28*c*),(28*d*) and a connection rod (28*e*) connecting the rods (28*c*),(28*d*), via an interlocking member (29), to maneuver in push-pull manner, by the maneuvering thereof in the machine body back-and-forth direction, the respective sliding spools (not shown) of the said maneuvering valve ($V_8$) for boom up-and-down rocking and the said maneuvering valve ($V_3$) for first confluence for increasing boom rocking speed, thus to both the said valves ($V_8$),($V_3$).

Midway between the said second maneuvering lever (15) and maneuvering valve ($V_5$) for bucket pivoting there is rotatably provided a bucket-maneuvering intermediary pipe shaft (38) with its axis directed in the machine body transverse direction. On this intermediary pipe shaft (38) there is downwardly protrudingly provided a first connection arm (39) for connecting the said push-pull rod (26*b*) to the sliding spool (not shown) of the said maneuvering valve ($V_5$), with one end of the said push-pull rod (26*b*) rockably pivoted on tip end portion thereof.

Furthermore, in order to rockably connect the said push-pull rod (26*a*) to a connection arm (27*b*) downwardly protrudingly provided on a pipe shaft (27*a*) of an interlocking member (27) adapted to pivot the said bucket-maneuvering intermediary pipe shaft (38) by the maneuvering of the said second maneuvering lever (15) in the machine body lateral direction, there is downwardly protrudingly provided on the said intermediary pipe shaft (38) a second connection arm (40).

Figure 4:
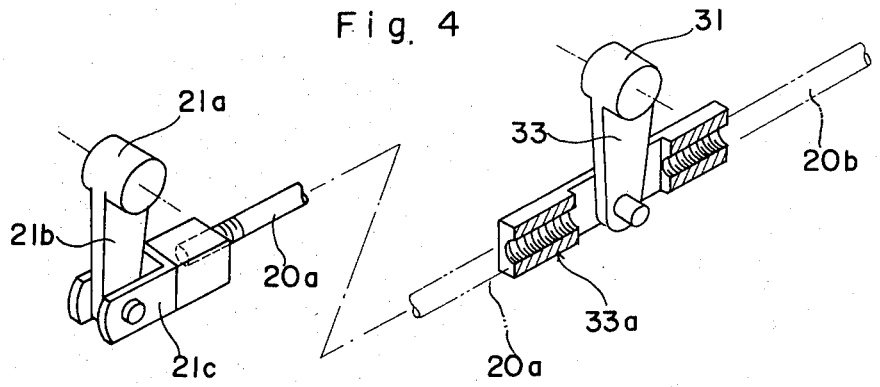
FIG. 4 is a view showing a portion of interlocking mode change-over mechanism partly cut away and partly in section.

Means for connecting the said respective push-pull rods (26*a*),(26*b*) and the respective first and second connection arms (39),(40), and the rod (26*b*) and the said connection arm (27*b*), will become clear at the description of FIG. 4, to be given hereinafter.

Midway around the said second interlocking system ($R_2$) and sixth interlocking system ($R_6$) between the said first and second maneuvering levers (14),(15) and both the said maneuvering valves ($V_2$),($V_8$), there is provided an interlocking mode change-over mechanism (30) adapted to change over the modes of the respective interlocking relationships.

As this interlocking mode change-over mechanism (30), an arm-maneuvering intermediary pipe shaft (31) and a boom-maneuvering intermediary pipe shaft (32) are rotatably provided in parallel to each other, more particularly these intermediary pipe shafts (31),(32) are so disposed that their rotation axes extend in the direction normal to the maneuvering direction of the said respective juxtaposed push-pull rods (20*a*),(28*a*) of the second interlocking system ($R_2$) and the sixth interlocking system ($R_6$). Now, on the said arm-maneuvering intermediary pipe shaft (31) there are protrudingly provided in one and the same direction, namely both downwardly: a first connection arm (33) for connecting the push-pull rod (20*a*) of the said second interlocking system ($R_2$), made releasable and remountable, interlockingly with the said first maneuvering lever (14); and a second connection arm (34) for enabling its interlocking connection with the said second maneuvering lever (15) by modifyingly remounting the said releasable and remountable push-pull rod (20*a*).

On the other hand, on the said boom-maneuvering intermediary pipe shaft (32) there are protrudingly provided in one and the same direction, namely both downwardly: a first connection arm (35) for connecting the push-pull rod (28*a*) of the said sixth interlocking system ($R_6$), made releasable and remountable, interlockingly with the said second maneuvering lever (15); and a second connection arm (36) for connecting same interlockingly with the said first maneuvering lever (14). At the tip end portion of the first connection arm (33) of the said arm-maneuvering intermediary pipe shaft (31) there is pivotally attached, as shown in FIG. 4, a connection member (33*a*), screw bores being threaded in both end portions of this connection member (33*a*) and the said push-pull rods (20*a*),(20*b*) being respectively screwed into these screw bores. A connection member (36*a*) of the structure the same as this connection member (33*a*) is pivotally attached to the tip end portion of the second connection arm (36) of the said boom-maneuvering intermediary pipe shaft (32).

On the other hand, on a first connection arm (21*b*) downwardly protrudingly provided on a pipe shaft (21*a*) forming a part of the interlocking member (21) of the said first maneuvering lever (14) there is pivotally attached a yoke (21*c*) at the tip end thereof, and to this yoke (21*c*) there is screwingly attached the other end of the said push-pull rod (20*a*).

Thus, the said push-pull rod (20*a*) is releasable from and remountable to both the said connection arms (33), (21*b*).

Figure 5:
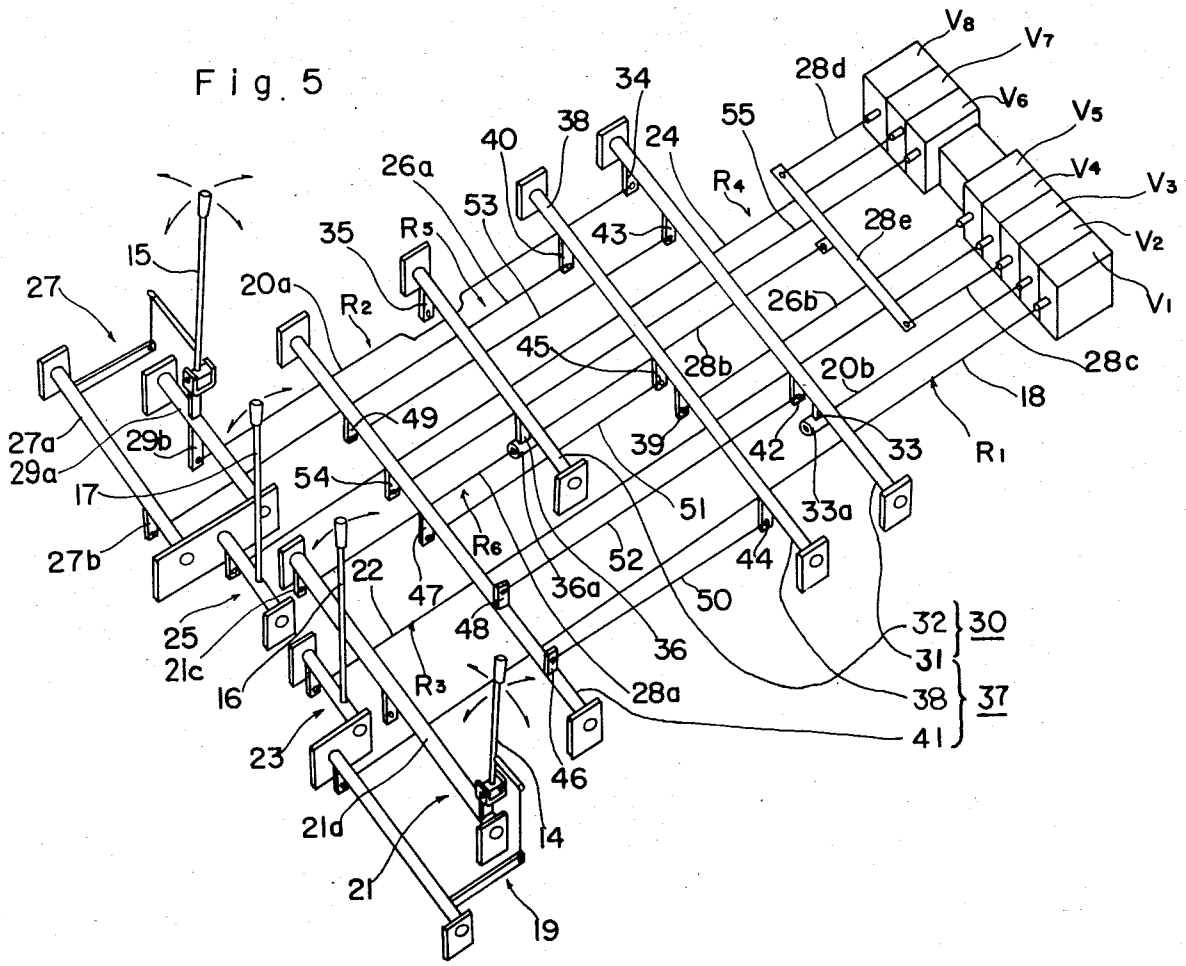
FIG. 5 is a schematic perspective view of the control handle structure, showing a state for interlocking relationship as has been changed over.

The reason why the intermediary portion of the said push-pull rod (20*a*) is (see FIG. 3) arcuate is to make this rod (20*a*)-when modifyingly remounted, for interlocking interconnection of the second connection arm (34) of the said arm-maneuvering intermediary pipe shaft (31) and the said second maneuvering lever (15), to bridge between a connection arm (29*b*), downwardly protrudingly provided on a pipe shaft (29*a*) forming a part of the interlocking member of this lever (15), and the said second connection arm (34)-not to abut against the first connection arm (35) of the said boom-maneuvering intermediary pipe shaft (32) (see FIG. 5).

By means of the above-mentioned interlocking mode change-over mechanism (30), it is possible to change over the maneuvering of the said maneuvering valve ($V_2$) for arm rocking, from the first maneuvering lever (14) to the second maneuvering lever (15), simply by altering the mounting position of the said push-pull rod (20*a*). Likewise, it is possible to change over the maneuvering of the said maneuvering valve ($V_8$) for boom up-and-down rocking and of the said maneuvering valve ($V_3$) for first confluence, from the said second maneuvering lever (15) to the said first maneuvering lever (14), simply by altering the mounting state of another push-pull rod (28*a*) from the state of connecting the first connection arm (35) of the said boom-maneuvering intermediary pipe shaft (32) and the connection arm (29*b*) of the said second maneuvering lever (15) to the state of connecting the second connection arm (36) of the said boom-maneuvering intermediary pipe shaft (32) and a second connection arm (21*c*) downwardly protrudingly provided on the pipe shaft (21*a*) of the interlocking member (21) of the said first maneuvering lever (14). FIG. 5 shows this interlocking connection mode. This maneuvering combination mode is generally prevailing in the U.S.A. As illustrated, it is possible to maneuver: the maneuvering valve ($V_8$) for boom up-and-down rocking and the maneuvering valve ($V_3$) for first confluence for speed increasing thereof by means of maneuvering of one, namely the first, maneuvering lever (14) in the machine body back-and-forth direction, and the maneuvering valve ($V_1$) for boom swiveling by means of maneuvering in the machine body transverse direction; and to maneuver: to maneuvering valve ($V_2$) for arm rocking by means of maneuvering the other, namely the second, maneuvering lever (15) in the machine body back-and-forth direction, and the maneuvering valve ($V_5$) for bucket pivoting by means of maneuvering in the machine body transverse direction. As for other structures in FIG. 5, such are substantially the same as the structures in FIG. 3, and description in detail thereof shall therefore be omitted.

Figure 6:
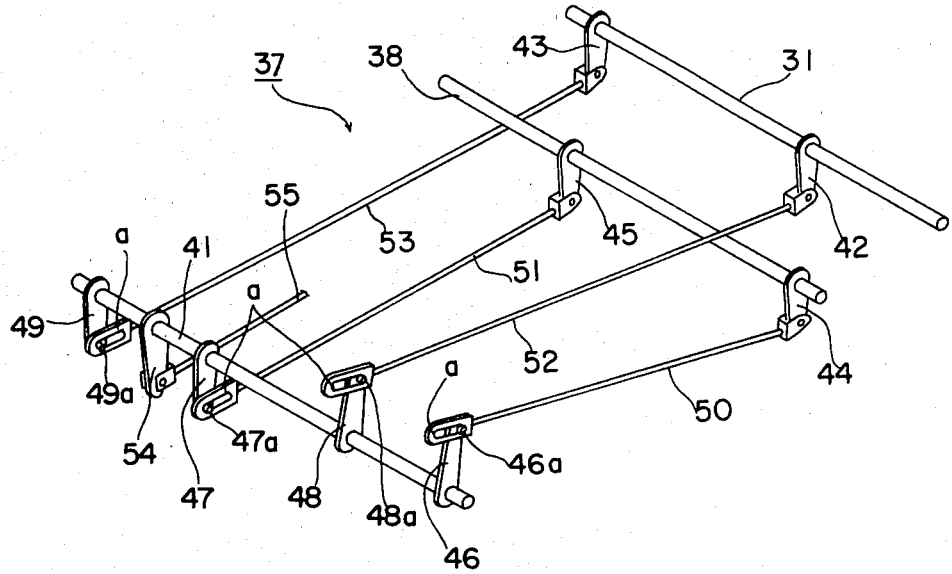
FIG. 6 is a schematic perspective view showing confluence maneuvering mechanism.
Figure 7:
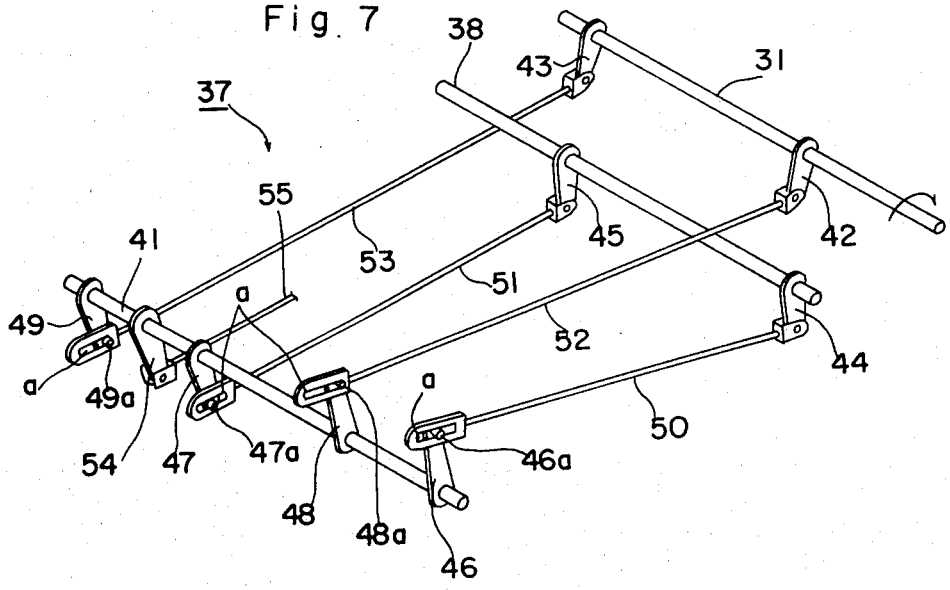
FIG. 7 is a schematic perspective view of the confluence maneuvering mechanism, showing the state of maneuvering same.

Now, description is given, with reference to FIG. 3, FIG. 6 and FIG. 7, of a confluence maneuvering mechanism (37) capable of maneuvering the said maneuvering valve ($V_6$) for second confluence, upon having maneuvered the maneuvering valve ($V_2$) for arm rocking by means of the first maneuvering lever (14) in FIG. 3 and the maneuvering valve ($V_5$) for bucket pivoting by means of the second maneuvering lever (15) either simultaneously or separately individually, without suffering from interference therebetween. The confluence maneuvering mechanism (37) is constructed with: the said arm-maneuvering intermediary pipe shaft (31); the said bucket-maneuvering intermediary pipe shaft (38); and an intermediary pipe shaft (41) for confluence maneuvering, rotatably provided in parallel with these pipe shafts (31),(38). As shown in FIG. 6, on the said arm-maneuvering intermediary pipe shaft (31) and bucket-maneuvering intermediary pipe shaft (38) there are consolidatedly provided respective pairs of third and fourth connection arms (42), (43),(44),(45) as spaced apart in the machine body transverse direction and protruding downwardly. On the said intermediary pipe shaft (41) for confluence maneuvering there are respectively consolidatedly provided—at the positions in the machine body transverse direction in substantially the same phase as the said connection arms (42)-(45)—a first, a second, a third and a fourth connection arms (46),(47),(48),(49) to correspond in pairs of two each, to the third and fourth connection arms (42),(43), (44),(45) of the intermediary pipe shafts (31),(38), respectively; with each one thereof (46),(48) extending upwardly and the other (47),(49) extending downwardly; and on free end side of these connection arms (46)–(49) there are provided pins (46*a*),(47*a*), (48*a*),(49*a*), respectively. At the connecting portions on one end side of push-pull rods (50),(51),(52), (53) for connection, adapted to engage with these pins (46*a*), (47*a*), (48), (49*a*), there respectively are defined oblong openings (a); while portions on the other end side thereof are respectively pivotally affixed to the third and fourth connection arms (44), (45) of the said bucket-maneuvering intermediary pipe shaft (38) and to the third and fourth connection arms (42), (43) of the said arm-maneuvering intermediary pipe shaft (31). Furthermore, on the said confluence maneuvering intermediary pipe shaft (41) there is protrudingly provided a fifth connection arm (54) extending downwardly, and a push-pull rod (55) interconnects same and the said valve ($V_6$) for second confluence. As for the positional relationship of the said pins (46*a*), (47*a*),(48*a*),(49*a*) relative to the respective oblong openings (a) of the said push-pull rods (50),(51),(52), (53), it is so made that the pins (46*a*),(48*a*) of the upwardly protrudingly provided first and third connection arms (46),(48) are positioned, when the said maneuvering valve ($V_1$) for arm rocking and the said maneuvering valve ($V_5$) for bucket pivoting are in the neutral position, at the end of the said respective oblong openings (a) on the side toward said both the maneuvering valves ($V_1$),($V_5$), as shown in FIG. 6, while the pins (47*a*),(49*a*) of the downwardly protrudingly provided second and fourth connection arms (47),(49) are positioned at the end of the said respective oblong openings (a) on the side toward the said first maneuvering lever (14). Therefore, when for instance the first maneuvering lever (14) has been maneuvered in pulling toward the machine body rear side for raising the arm (10) and thus the said arm-maneuvering intermediary pipe shaft (31) has been rotated via the said push-pull rod (20*a*), then the said push-pull rod (52) connected to this intermediary pipe (31) pushes the said pin (48*a*), and the said confluence maneuvering intermediary pipe shaft (41) is rotated in counterclockwise rotation, whereby the second confluence valve ($V_6$) is maneuvered via the fifth connection arm (54). At this time, the pin (46*a*) of the said first connection arm (46) makes displacement, as shown in FIG. 7, only to the middle of the opening (a) of the said push-pull rod (50), and thus exerts no influence on this rod (50). Thus, it is possible to retain in the neutral position the said maneuvering valve ($V_5$) for bucket pivoting which is maneuvered by the said push-pull rod (50) via the said bucket-maneuvering intermediary pipe shaft (38). In other words, the second maneuvering lever (15) suffers no interference from such maneuvering. With this construction, it is likewise apparent that the second maneuvering lever (15) and the said valve ($V_5$) for bucket pivoting suffer no interference even if the said first maneuvering lever (14) is maneuvered in the opposite direction, namely toward the machine body front side. The confluence maneuvering mechanism (37) thus gives play to its function as mentioned hereinabove by the combination of the positioning of the respective oblong openings (a) and the pins (46*a*),(47*a*), (48*a*),(49*a*) engaging therewith and the disposing of the protruding directions of the respective connection arms.

Now, on the interlocking mode change-over mechanism (30) to change over the interlocking relationship of the above-mentioned two maneuvering levers and four maneuvering valves, another form of the embodiment is described in detail hereunder with reference to FIG. 8–FIG. 13.

Figure 8:
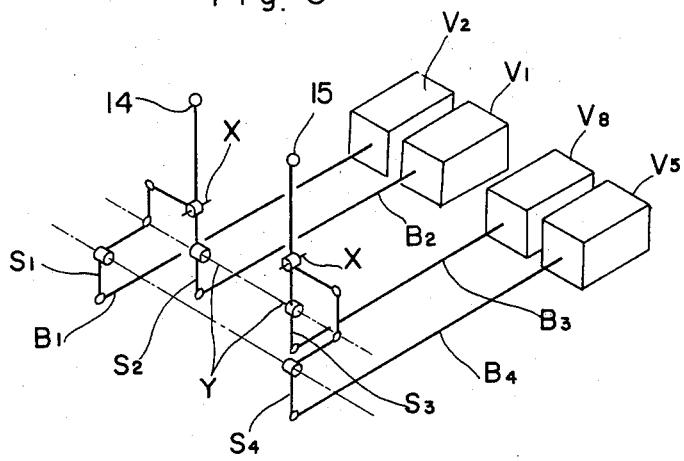
FIG. 8 is a schematic view showing interlocking relationship of another maneuvering section.

In constructing the maneuvering portion structure for the maneuvering valve ($V_1$) of the motor (M) for boom swiveling and the maneuvering valves ($V_8$),($V_2$),($V_5$) for the boom cylinder, for the cylinder and for the bucket cylinder, it is made up, as shown in FIG. 8, by connecting to two levers (14),(15) adapted to be maneuvered in bi-directional rocking about axes (X),(Y), more specifically to the maneuvering sections ($S_1$),($S_2$),($S_3$),($S_4$) thereof, rods ($B_1$),($B_2$),($B_3$),($B_4$)in juxtaposition extending in parallel to one another; and by engaging the valve ($V_2$) to the rod ($B_1$), the swivel valve ($V_1$) to the rod ($B_2$), the boom valve ($V_8$) to the rod ($B_3$) and the bucket valve ($V_5$) to the rod ($B_4$), in such state that the respective spools are in parallel to one another; to thus drive the swivel table (3) by the maneuvering of the first maneuvering lever (14) in back-and-forth rocking relative to the operation seat (4), the arm (10) by the maneuvering of the first lever (14) in right-and-left rocking, the boom (8) by the maneuvering of the second lever (15) in back-and-forth rocking and the bucket (12) by the maneuvering of the second lever (15) in right-and-left rocking, respectively.

Consideration is paid to make it possible to provide, midway around the said rod interlocking systems, the interlocking mode change-over mechanism (30) for altering the interlocking relationship of the levers (14), (15) and the sliding spools for the valves.

Figure 9:
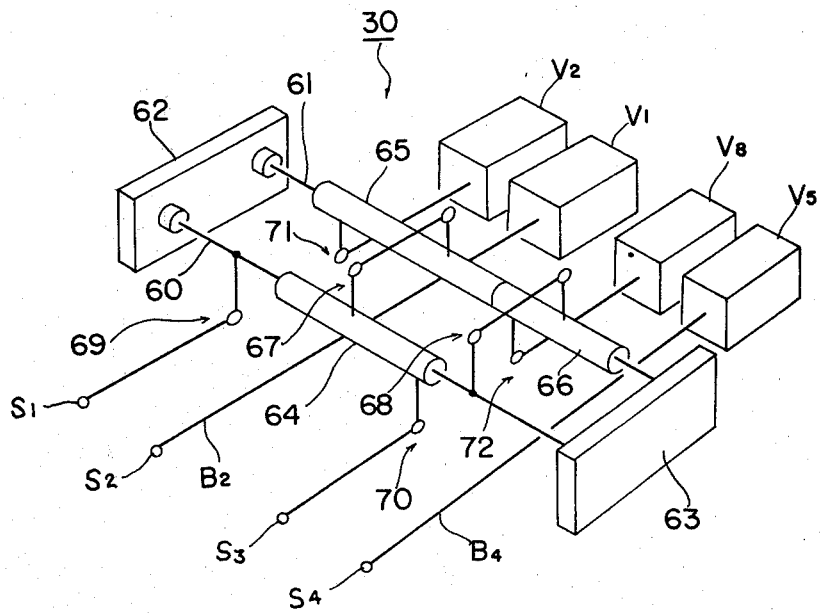
FIG. 9 is a schematic perspective view showing the control handle structure of FIG. 8.

In constructing the said interlocking mode change-over mechanism (30), it is made up, as shown in FIG. 9, by journaling, in brackets (62),(63) for free rotation, two, namely a first and a second interlocking shafts (60), (61), having the axes made to extend in the juxtaposed arraying direction of the rod interlocking systems; by fittingly putting a first tubular body (64) on and around an intermediary portion of the first shaft (60) and a second and a third tubular bodies (65), (66) on and around the second shaft (61), respectively in a manner free to make relative rotation; by securely fixing—respectively on to the first tubular body (64) and the second tubular body (65) and on the first shaft (60) and the third tubular body (66)—two sets of first interlocking devices (67), (68) formed each by pivotally bridging a link over two arms; and by securely fixing—respectively on to the first shaft (60) and the first, second and third tubular bodies (64),(65),(66)—second interlocking devices (69),(70),(71),(72) formed each by pivotally connecting a rod on an arm.

Figure 10:
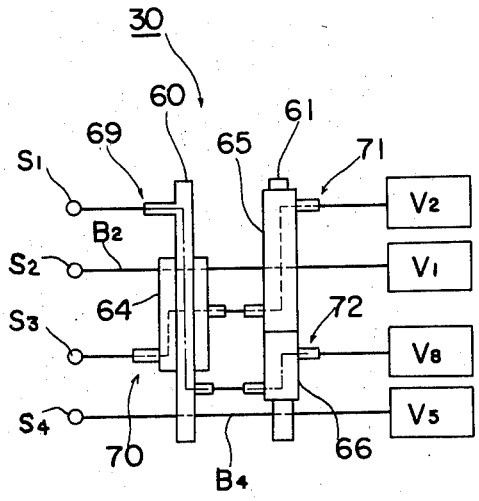
FIG. 10 is a plan view of the control handle structure of FIG. 8, for interlocking relationship as has been changed over.

In altering the interlocking systems by means of the interlocking mode change-over mechanism (30) of the above-described construction in the rod interlocking systems shown in FIG. 8, it is possible to obtain rod interlocking systems which will alter the maneuvering objects—more specifically the arm (10) and the boom (8) by the maneuvering levers (14), (15)—by dismantling the rods ($B_1$), ($B_3$) and by respectively pivotably connecting, as shown in FIG. 10, the interlocking device (69) of the first shaft (60) with the maneuvering section ($S_1$), the interlocking device (70) of the first tubular body (64) with the maneuvering section ($S_3$), the interlocking device (71) of the second tubular body (65) with the maneuvering valve ($V_2$), and the interlocking device (72) of the third tubular body (66) with the maneuvering valve ($V_8$). Besides, it is possible to obtain rod interlocking systems which will alter the maneuvering objects—more specifically the swivel table (3) and the bracket (12)—in the rod interlocking systems shown in FIG. 8, by dismantling the rods ($B_2$), ($B_4$) and inverting the interlocking shafts (60), (61) and further by respectively pivotally connecting, as shown in FIG. 11, the interlocking device (70) of the first tubular body (64) with the maneuvering section ($S_2$), the interlocking device (69) of the first shaft (60) with the maneuvering section ($S_4$), the interlocking device (72) of the third tubular body (66) with the maneuvering valve ($V_1$), and the interlocking device (71) of the second tubular body (65) with the maneuvering valve ($V_5$).

Figure 11:
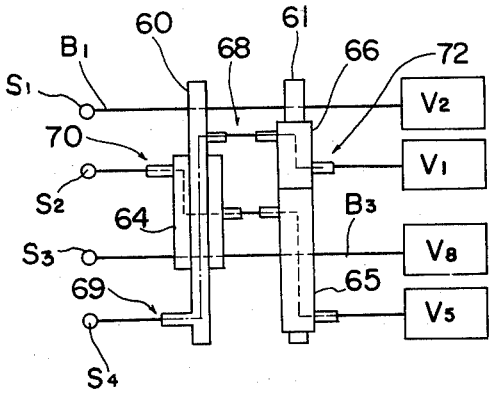
FIG. 11 is a plan view of the control handle structure of FIG. 8, for interlocking relationship as has been changed over.
Figure 12:
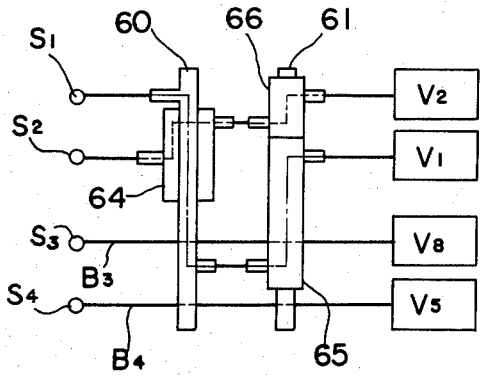
FIG. 12 is a plan view of the control handle structure of FIG. 8, for interlocking relationship as has been further changed over.

Still further, this interlocking mode change-over mechanism (30) may be so made, as shown in FIG. 12, by disposing the first shaft (60) in the state as that of FIG. 10 while as for the first tubular body (64), the second tubular body (65) and the third tubular body (66) commonly making them move upwardly from the state as that of FIG. 11 and rotating them by 180°, thus to respectively interlockingly connect; the maneuvering section ($S_1$) of the maneuvering in the machine body back-and-forth direction of the said first maneuvering lever (14) with the maneuvering valve ($V_1$); the maneuvering section ($S_2$) of the maneuvering in the machine body transverse direction of the said first maneuvering lever (14) with the maneuvering valve ($V_2$) the rod ($B_3$), connected to the maneuvering section ($S_3$) of the maneuvering in the machine body back-and-forth direction of the said second maneuvering lever (15), with the said maneuvering valve ($V_8$) for boom up-and-down rocking; and the rod ($B_4$), connected to the maneuvering section ($S_4$) of the maneuvering in the machine body transverse direction of the said second maneuvering lever (15), with the said maneuvering valve ($V_5$) for bucket pivoting.

Figure 13:
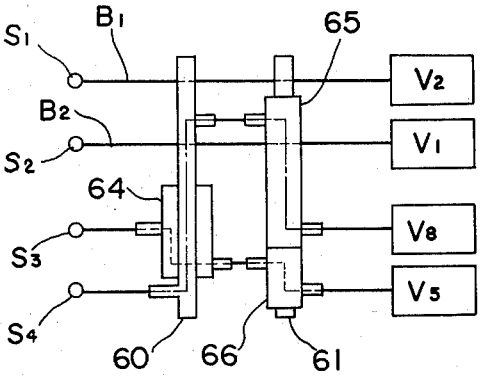
FIG. 13 is a plan view of the maneuvering portion structure of FIG. 8, for interlocking relationship as has been further changed over.

Yet further, the said interlocking mode change-over mechanism (30) may as well be made in such construction, as shown in FIG. 13, where the first shaft (60), the first tubular body (64), the second tubular body (65) and the third tubular body (66) are inverted from the state of FIG. 12, with the middle portion of the first and the second shafts (60), (61) as the inversion center. Therefore, it is made possible to maneuver the said maneuvering valve ($V_2$) for arm rocking by means of the maneuvering of the first maneuvering lever (14) in the machine body lateral direction, and the said maneuvering valve ($V_1$) for boom swiveling by means of the maneuvering thereof in the machine body back-and-forth direction; and it is made possible to maneuver the said maneuvering valve ($V_8$) for boom up-and-down rocking by means of the maneuvering of the second maneuvering lever (15) in the machine body back-and-forth direction, and the said maneuvering valve ($V_5$) for bucket pivoting by means of the maneuvering thereof in the machine body transverse direction. With provision as mentioned hereinabove, thus for having interlocking rotation shafts interpose in the interlocking systems, which shafts are adapted for alterable interlocking relationship with push-pull rods, in such manner as to once transform, midway in the interlocking systems, the linear movements of the rods to rotational movements and take out the rotational movements from the respective different locations in the rod juxtaposed arraying direction, and to restoringly transform the rotational movements back to the linear movements and transmit same to the valve spools, and so forth; it is made possible, in the case the give mode of the maneuvering is different from the previously conversant maneuvering mode, to modify the given mode to conform to such previous maneuvering mode, thus to bring forth the advantage of managing to properly use any different set of the machines safely with excellent work efficiency always retaining one and the same maneuvering sense with such provision of the versatile construction ready for altering the maneuvering mode upon any possible need.

By the way, though it has been supposed to cause swiveling of the boom (8) by means of the swiveling maneuvering of the swivel table (3), it is as well possible to provide a maneuvering valve for a cylinder rocking, either instead of the swivel valve ($V_1$), or else to provide a flow path change-over valve for such cylinder and the motor (M) for boom swiveling so as to have the valve ($V_1$) dually serve also for causing the boom (8) to make rocking by means of the cylinder rocking.

As is clear from the above description, the maneuvering portion structure of an excavation work vehicle, according to this invention, can alter the maneuvering systems thereof in order to realize excavation work without erroneous maneuvering and without lowering the work efficiency even by any operator and under any actual condition prevailing in the pertinent country, thus having any different mode of the maneuvering as habit or custom, and is thus of the tremendous advantage in the industrial application thereof.

I claim:

1. A control handle structure of an excavation work vehicle, characterized in that a maneuvering valve ($V_1$) for boom swiveling, a maneuvering valve ($V_8$) for boom up-and-down rocking, a maneuvering valve ($V_2$) for arm rocking and a maneuvering valve ($V_5$) for bucket pivoting are disposed substantially in parallel; that the four maneuvering valves ($V_1$),($V_8$),($V_2$),($V_5$) are interlockingly connected, in a manner capable of separate individual maneuvering and capable of simultaneous maneuvering in respective pairs, via first, second, third and fourth interlocking systems ($R_1$), ($R_6$), ($R_2$), ($R_5$) parallel with one another using respective push-pull rods, to two maneuvering levers (14), (15) adapted for free rocking, bi-directional maneuvering in back-and-forth and right-and-left directions of the vehicle; that there is provided, intermediary of the interlocking systems ($R_1$), ($R_6$), ($R_2$), ($R_5$), an interlocking mode change-over mechanism (30) for changing the mode of the interlocking between said two maneuvering levers (14), (15) and said four maneuvering valves ($V_1$), ($V_8$), ($V_2$), ($V_5$);

that the interlocking mode change-over mechanism connects the maneuvering valve ($V_1$) for boom swiveling and maneuvering valve ($V_2$) for arm rocking interlockingly with said one maneuvering lever (14) and connects the maneuvering valve ($V_8$) for boom up-and-down rocking and said maneuvering valve ($V_5$) for bucket pivoting interlockingly with the said other maneuvering lever (15);

that the interlocking mode change-over mechanism (30) connects the maneuvering valve ($V_1$) for boom swiveling and maneuvering valve ($V_8$) for boom up-and-down rocking interlockingly with said one maneuvering lever (14) and connects the maneuvering valve ($V_2$) for arm rocking and said maneuvering valve ($V_5$) for bucket pivoting interlockingly with said other maneuvering lever (15);

that in the interlocking mode change-over mechanism (30) there is rotatably provided an arm-maneuvering intermediary pipe shaft (31) and a boom-maneuvering intermediary pipe shaft (32), these intermediary pipe shafts (31), (32), being disposed with their rotation axes extending in the direction normal to the maneuvering direction of respective juxtaposed push-pull rods (20*a*), (20*b*), (28*a–d*) of the third interlocking system ($R_2$), and the second interlocking system ($R_6$); that on the arm-maneuvering intermediary pipe-shaft (31) there are protrudingly provided in the same direction a first connection arm (33), for connecting a partial member (20*a*), made releasable and remountable, out of push-pull rods (20*a*), (20*b*), of the third interlocking system ($R_2$) interlockingly with the one maneuvering lever (14), and a second connection arm (34), for connecting the releasable and remountable push-pull rod (20*a*) interlockingly with the said other maneuvering lever (15); and that on the said boom-maneuvering intermediary pipe shaft (32) there are protrudingly provided in the same direction a first connection arm (36), for connecting a releasable and remountable push-pull rod (28*a*) of the second interlocking system ($R_6$)., interlockingly with the one maneuvering lever (14), and a second connection arm (35), for connecting interlockingly with the other maneuvering lever (15).

2. The structure recited in claim 1 characterized in that the valve ($V_8$) for boom up-and-down rocking controls oil of a second fluid pressure pump ($P_2$); that the maneuvering valve ($V_1$) for boom swiveling, the maneuvering valve ($V_2$) for arm rocking and the maneuvering valve ($V_5$) for bucket pivoting are so interconnected by parallel circuits and a center bypassing circuit as to be capable of simultaneous driving and are constructed to control oil of a first fluid pressure pump ($P_1$); that a maneuvering valve ($V_3$), controlling oil of the said second fluid pressure pump ($P_2$) for first confluence in order to increase boom raising speed, is in a circuit parallel to the maneuvering valve ($V_1$) for boom swiveling, maneuvering valve ($V_2$) for arm rocking and maneuvering valve ($V_5$) for bucket pivoting, in juxtaposition thereto, and is connected by means of a connecting rod (28*e*) interlockingly with the said maneuvering valve ($V_8$) for boom up-and-down rocking, via the respective push-pull rods (28*d*), (28*c*), in order to have the oil of the said second fluid pressure pump ($P_2$) make confluence with the oil of the first fluid pressure pump ($P_1$) thus for increasing the boom (8) actuating speed; and that the connecting rod (28*e*) is connected to the said push-pull rod (28*e*) of the second interlocking system ($R_6$).

3. The structure recited in claim 2, characterized in that a meneuvering valve ($V_6$) for second confluence, connected to the maneuvering valve ($V_8$) for boom up-and-down rocking by means of a parallel circuit and a center bypass circuit, is provided in juxtaposition thereto, this maneuvering valve ($V_6$) being so constructed as to have the oil of the first fluid pressure pump ($P_1$) make confluence, by means of the center bypass circuit thereof when the said maneuvering valve ($V_8$) for boom up-and-down rocking is in the neutral position, with the oil of the second fluid pressure pump ($P_2$) thus for increasing the rocking speed of the arm (10) and the pivoting speed of the bucket (12); and that there is provided a confluence maneuvering mechanism capable of maneuvering the maneuvering valve ($V_6$) for second confluence always into the actuated state defining oblong openings at the respective tip end portions; that on the bucket-maneuvering intermediary pipe shaft (38) there are protrudingly provided, in the same direction as a first and a second connection arms (39), (40) provided hereon, a third connection arm (44) and a fourth connection arm (45) defining oblong openings at the respective tip end portions that on the pipe shaft (41) for confluence maneuvering there are provided, in the portions corresponding to said third and fourth connection arms (42)(43)(44)(45) of the two intermediary pipe shafts (31)(38), a first through a fourth connection arms (46)(47)(48)(49) out of those first through fourth connection arms (46),(47), (48), (49) the first connection arm (46) corresponding to the third connection arm (44) of the bucket-maneuvering intermediary pipe shaft (38) and the second connection arm (48) corresponding to the third connection arm (42) of the arm-maneuvering intermediary pipe shaft (31) being protrudingly provided in the direction opposite to said respective third connection arms (44), (42), while the remaining said third and fourth connection arms (47),(49) being provided in the same direction as the corresponding fourth connection arm (45) of the bucket-maneuvering intermediary pipe shaft (38) and fourth connection arm (43) of the arm-maneuvering intermediary pipe shaft (31) and in the same direction as this direction there position, any time when the said one maneuvering lever (14), to maneuver in push-pull manner the maneuvering valve ($V_2$) for arm rocking, and the other maneuvering lever (15) to maneuver in push-pull manner the maneuvering valve ($V_5$) for bucket pivoting, are maneuvered into actuated state positions either simultaneously or individually, without suffering from interference therebetween.

4. The structure recited in claim 3, characterized in that the said confluence maneuvering mechanism (37) comprises: a pipe shaft (41) for confluence maneuvering, rotatably provided in parallel with the said boom-maneuvering intermediary pipe shaft (32); a bucket-maneuvering intermediary pipe shaft (38), rotatably provided in parallel with a pipe shaft (41); that on the said arm-maneuvering intermediary pipe shaft (31) there are protrudingly provided, in one and the same direction just as the first and the second connection arms (33), (34) provided hereon, a third connection arm (42) and a fourth connection arm (43) defining oblong openings (a), (a) at the respective tip end portions; that on the said bucket-maneuvering intermediary pipe shaft (38) there are protrudingly provided, in one and the same direction just as a first and a second connection arms (39), (40) provided hereon, a third connection arm (44) and a fourth connection arm (45), defining oblong openings (a), (a) at the respective tip end portions; that on the said pipe shaft (41) for confluence maneuvering there are provided, in the portions corresponding to the said third and fourth connection arms (42), (43), (44), (45) of the two intermediary pipe shafts (31), (38), a first through a fourth connection arms (46), (47), (48), (49), out of those first through fourth connection arms (46), (47), (48), (49) the first connection arm (46) corresponding to the third connection arm (44) of the said bucket-maneuvering intermediary pipe shaft (38) and the second connection arm (48) corresponding to the third connection arm (42) of the said arm-maneuvering intermediary pipe shaft (31) being protrudingly provided in the direction opposite to the said respective third connection arms (44), (42), while the remaining said third and fourth connection arms (47), (49) being provided in one end and the same direction as the corresponding fourth connection arm (45) of the said bucket-maneuvering intermediary pipe shaft (38) and fourth connection arm (43) of the said arm-maneuvering intermediary pipe shaft (31) and in the direction also the same as this direction there further being protrudingly provided a fifth connection arm (54) on the pipe shaft (41) for confluence maneuvering; that this fifth connection arm (54) and the maneuvering valve ($V_6$) for second confluence are interlockingly connected by means of a push-pull rod (55); and that in the respective oblong openings in the respectively corresponding connection arms (44), (46), (42), (48), (45), (47), (43), (49), there are engaged push-pull rods (50), (52), (51), (53), respectively, wherein the respective tip ends of these push-pull rods (50), (52), (51), (53), and the oblong openings are so positioned that the maneuvering valve ($V_6$), said maneuvering valve ($V_2$) and the maneuvering valve ($V_5$), may be operated without interference therebetween.

5. The structure recited in claim 1 characterized in that the four interlocking mechanisms ($R_1$),($R_6$),($R_2$),($R_5$) comprise rod interlocking systems ($B_1$), ($B_3$),($B_2$),($B_4$) corresponding to maneuvering sections ($S_1$), ($S_3$),($S_2$),($S_4$) in transverse direction to the vehicle and and back-and-forth direction of the first and second maneuvering levers (14),(15); and that the interlocking mode change-over mechanism (30) is constructed by journaling, in brackets (62),(63) for free rotation, two, namely a first and a second, interlocking shafts (60),(61), having the axes made to extend in juxtaposed arraying direction of these rod interlocking systems ($B_1$)($B_3$),($B_2$),($B_4$); by fittingly putting a first tubular body (64) on and around an intermediary portion of the said first shaft (60), and a second and a third tubular bodies (65),(66) on and around the said second shaft (61), respectively in a manner free to make relative rotation; by securely fixing—respectively on to the said first tubular body (64) and the said second tubular body (65) and on to the said first shaft (60) and the third tubular body (66)—two sets of first interlocking devices (67), (68) formed each by pivotally bridging a link over two arms; and by securely fixing—respectively on to the said first shaft (60) and the said first, second and third tubular bodies (64),(65),(66)—second interlocking devices (69),(70),(71),(72) formed each by pivotally connecting a rod on an arm.

6. The structure recited in claim 5, characterized in that the rods ($B_1$), ($B_3$) have been dismantled; and that the following have been respectively pivotally connected; the interlocking device (69) of the first shaft (60) with the maneuvering section ($S_1$) of the maneuvering in the back-and-forth direction of the first maneuvering lever (14); the interlocking device (70) of the first tubular body (64) with the maneuvering section ($S_3$) of the maneuvering in the back-and-forth direction of the second maneuvering lever (15); the interlocking device (71) of the second tubular body (65) with the maneuvering valve ($V_2$) for arm rocking; and the interlocking device (72) of the third tubular body (66) with the said maneuvering valve ($V_8$) for boom up-and-down rocking.

7. The structure recited in claim 5, characterized in that rods ($B_2$), ($B_4$) have been dismantled; that the said interlocking shafts (60),(61) have been inverted and that the following have been respectively pivotally connected; the interlocking device (70) of the first tubular body (64) with the maneuvering section ($S_2$) of the maneuvering in the transverse direction of the first maneuvering lever (14); the interlocking device (69) of the first shaft (60) with the maneuvering section ($S_4$) of the maneuvering in the transverse direction of the said second maneuvering lever (15); the interlocking device (72) of the third tubular body (66) with the maneuvering valve ($V_1$) for boom swiveling; and the interlocking device (71) of the secind tubular body (65) with the said maneuvering valve ($V_5$) for bucket pivoting.

8. The structure recited in claim 5 characterized in that the said interlocking mode change over mechanism (30) is so made, by combination of connection of the said first and second interlocking shafts (60),(61) with the said first, second and third tubular bodies (64),(65),(66), as to respectively interlockingly connect: to said maneuvering valve ($V_2$) for arm rocking with the maneuvering section ($S_2$) of the maneuvering in the machine body transverse direction of the said first maneuvering lever (14); the said rod ($B_3$), connected to the maneuvering section ($S_3$) of the maneuvering in the machine body back-and-forth direction of the said second maneuvering lever, (15), with the said maneuvering valve ($V_8$) for boom up-and-down rocking; and the said rod ($B_4$), connected to the maneuvering section ($S_4$) of the maneuvering in the machine body transverse direction of the second maneuvering lever (15), with the said maneuvering valve ($V_5$) for bucket pivoting.

* * * * *